US007706738B2

(12) United States Patent
Ahn

(10) Patent No.: US 7,706,738 B2
(45) Date of Patent: Apr. 27, 2010

(54) PAPER DISCHARGE DEVICE AND IMAGE FORMING APPARATUS HAVING THE SAME

(75) Inventor: Byung-Sun Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/292,720

(22) Filed: Nov. 25, 2008

(65) Prior Publication Data

US 2009/0087241 A1 Apr. 2, 2009

Related U.S. Application Data

(62) Division of application No. 11/062,567, filed on Feb. 23, 2005, now abandoned.

(30) Foreign Application Priority Data

May 25, 2004 (KR) ..... 2004-0037251

(51) Int. Cl.
*G03G 15/00* (2006.01)

(52) U.S. Cl. ..... 399/406; 399/405

(58) Field of Classification Search ..... 399/405, 399/320, 328, 400, 406; 400/625
See application file for complete search history.

(56) References Cited

U.S. PATENT DOCUMENTS

| | | | |
|---|---|---|---|
| 4,693,587 | A | 9/1987 | Shigenobu et al. |
| 4,717,938 | A | 1/1988 | Tanjo |
| 5,450,181 | A | 9/1995 | Tsukida et al. |
| 5,689,788 | A | 11/1997 | Moser |
| 6,478,295 | B2 | 11/2002 | Hwang et al. |

FOREIGN PATENT DOCUMENTS

| | | |
|---|---|---|
| JP | 09-315651 | 12/1997 |
| JP | 11-311893 | 11/1999 |
| JP | 2002-173249 | 6/2002 |
| JP | 2003-146489 | 5/2003 |

*Primary Examiner*—Ren Yan
(74) *Attorney, Agent, or Firm*—Roylance, Abrams, Berdo & Goodman, L.L.P.

(57) ABSTRACT

A paper discharge device and an image forming apparatus having the same are provided. In the paper discharge device, the paper discharge roller has a non-uniform diameter extending in a longitudinal direction and the idle roller contacts with the paper discharge roller in the longitudinal direction of the paper discharge roller so that the print paper unfolds and discharges utilizing a velocity differential at a nip between the paper discharge roller and the idle roller.

17 Claims, 5 Drawing Sheets

PAPER DISCHARGE DEVICE AND IMAGE FORMING APPARATUS HAVING THE SAME

This application claims the benefit under 35 U.S.C. §119 (a) of Korean Patent Application No. 10-2004-0037251, entitled "Paper Discharge Device and Image Forming Apparatus Having the Same," filed on May 25, 2004, the entire disclosure of which is incorporated hereby incorporated by reference. This application is a divisional of U.S. patent application Ser. No. 11/062,567 (filed Feb. 23, 2005), now abandoned which is hereby incorporated by reference.

BACKGROUND OF THE INVENTION

1. Field of the Invention

The present invention relates to an image forming apparatus. More particularly, the present invention relates to a paper discharge device capable of stably discharging paper, on which an image is formed, in an unfolded state.

2. Description of the Related Art

In general, an image forming apparatus such as a printer produces electrostatic latent images on a photosensitive drum in response to print data. The image forming apparatus utilizes an exposure unit that supplies toner as a developing agent to form the electrostatic latent images as toner images, transfers the toner images to print paper, and fuses them on the print paper. Thus, a desired image is obtained.

The print paper is discharged to the outside of the image forming apparatus using a paper discharge device. A portion of the print paper has toner images fused thereon. Additionally, portions of the print paper are blank. Consequently, a humidity differential arises between the toner image fused portion and the blank portion. Therefore, due to the humidity differential and a variety of other factors, the print paper S often wrinkles. This humidity differential also contributes to print paper curling.

Curling of the print paper causes difficulties when transferring the print paper. As a result, paper jams occur and the print paper blocks the transfer path and prevents transfer.

Thus, the print paper requires unfolding prior to being discharged to the outside of paper discharge device.

FIG. 1 is a front view of a conventional paper discharge device, and FIG. 2 is a rear view of the paper discharge device of FIG. 1.

The paper discharge device of FIGS. 1-2 comprises a paper discharge unit 70 and a plurality of idle rollers 73. A plurality of paper discharge rollers 72 are disposed in the paper discharge unit 70 and extend in a longitudinal direction of a paper discharge shaft 71. The plurality of idle rollers 73 are installed to face the plurality of paper discharge rollers 72. Transferred print paper S is placed between the paper discharge roller 72 and the idle roller 73, and presses the print paper S toward the paper discharge roller 72 using a spring 74.

The idle rollers 73 have the same diameter and extend in the longitudinal direction of the paper discharge shaft 71. Each roller 72, 73 is preferably inclined by an angle of about 0 with respect to the paper discharge shaft 71. That is, a shaft of the idle rollers 73 are inclined relative to the paper discharge rollers 72. Furthermore, each of the idle rollers 73 contacts a respective paper discharge rollers 72 and inclines from an inside of the paper discharge roller 72 to an outside thereof.

Thus, when each idle roller 73 contacts each of the paper discharge rollers 72, a force F1 is created at a predetermined angle which extends from the inside of the paper discharge roller 72 to the outside thereof. The force is generated in each nip between the idle roller 73 and the paper discharge roller 72.

Thus, the print paper S is unfolded from an inside to an outside by the force F1. Consequently, the print paper S is discharged to the outside in an unfolded state.

Since the idle roller 73 is preferably inclined by an angle of about 0 with respect to the paper discharge roller 72, a velocity vector of the paper discharge roller 72 and a velocity vector of the idle roller 73 do not extend in the same direction, but incline by a predetermined angle. As such, friction increases in the nip, and non-uniform pressure is applied in the longitudinal direction to the print paper S. Thus, wear occurs in the nip. During prolonged use, wear rapidly occurs in the nip portion, and results in diminished reliability.

Accordingly, there is a need for an image forming apparatus having a improved paper discharge device that prevents roller wear and prolongs the life of the paper discharge device and enhances the reliability thereof.

SUMMARY OF THE INVENTION

An aspect of the present invention is to solve at least the above problems and/or disadvantages and to provide at least the advantages described below. Accordingly, an aspect of the present invention is to provide a paper discharge device capable of preventing partial wear of a paper discharge roller by applying uniform pressure and contact driving in a longitudinal direction between the paper discharge roller and an idle roller.

According to an aspect of the present invention, there is provided a paper discharge device, the paper discharge device comprises a paper discharge roller and an idle roller facing the paper discharge roller. Print paper is rotatably positioned between the paper discharge roller and the idle roller. The paper discharge roller has a non-uniform diameter which extends in a longitudinal direction and the idle roller contacts a surface of the paper discharge roller in the longitudinal direction of the paper discharge roller so that the print paper unfolds and discharges utilizing a velocity differential at a nip between the paper discharge roller and the idle roller.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
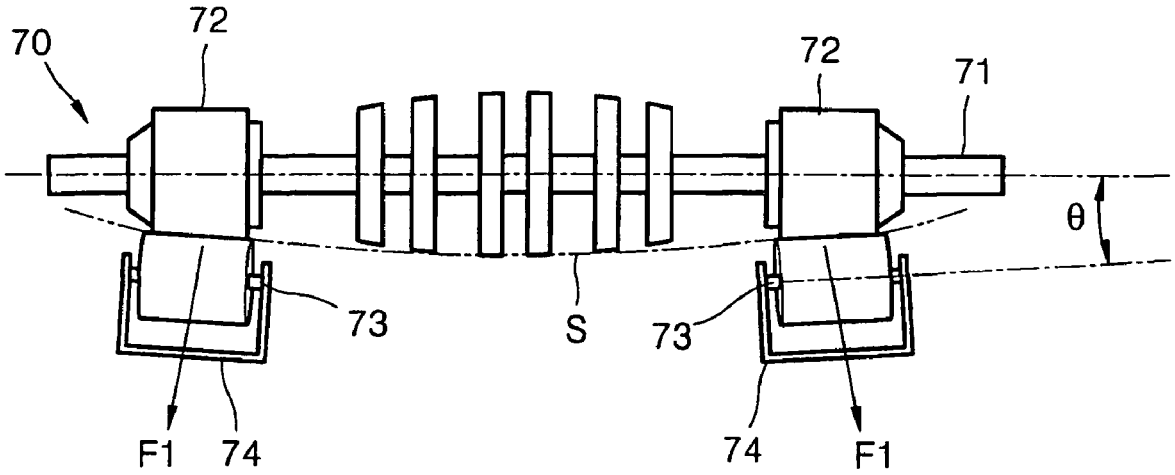
FIG. 1 (PRIOR ART)
FIG. 1 is a front view of a conventional paper discharge device.
Figure 2:
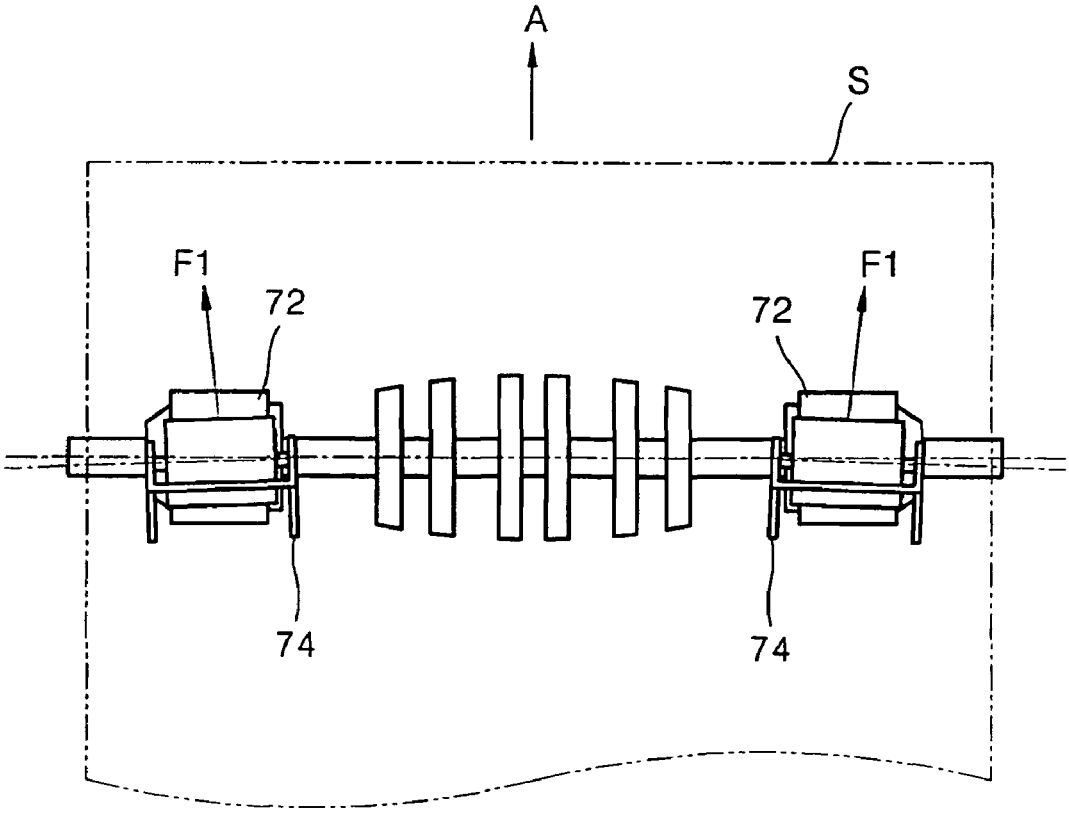
FIG. 2 (PRIOR ART)
FIG. 2 is a rear view of the paper discharge device of FIG. 1.
Figure 3:
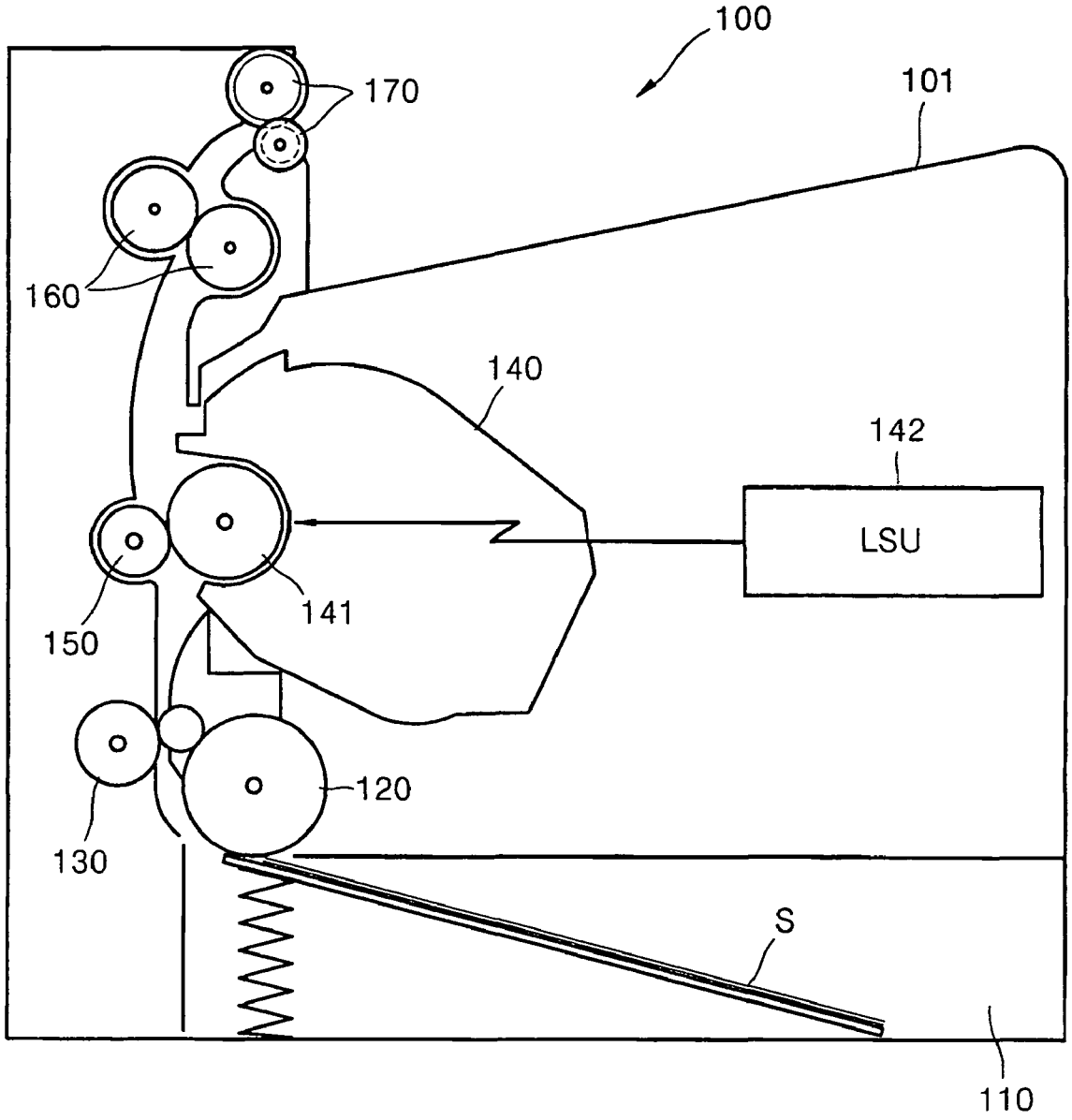
FIG. 3 is a side view of the structure of an image forming apparatus utilizing a paper discharge device in accordance with a first embodiment of the present invention.
Figure 4:
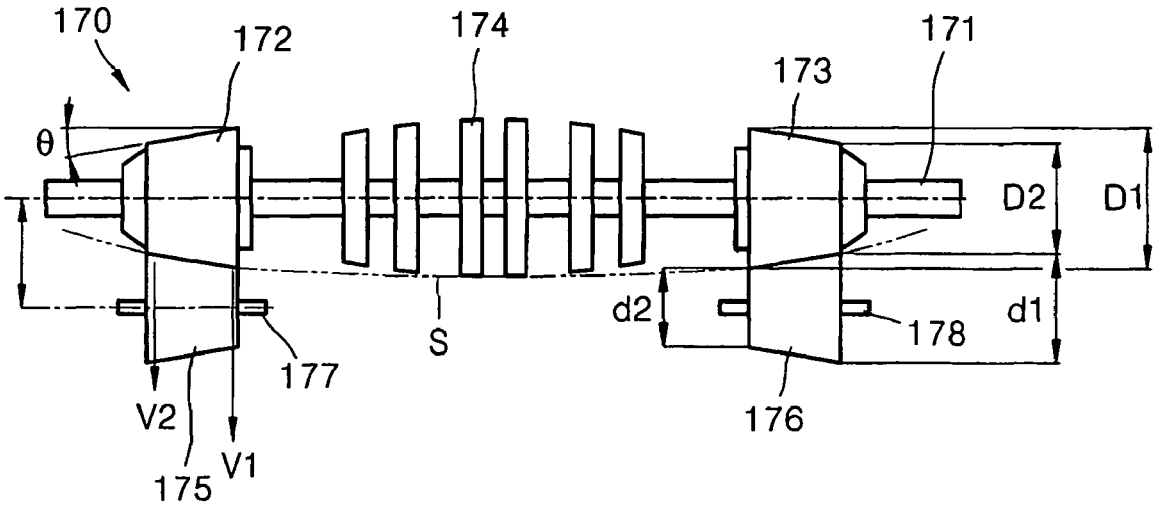
FIG. 4 is a front view of the paper discharge device of FIG. 3.
Figure 5:
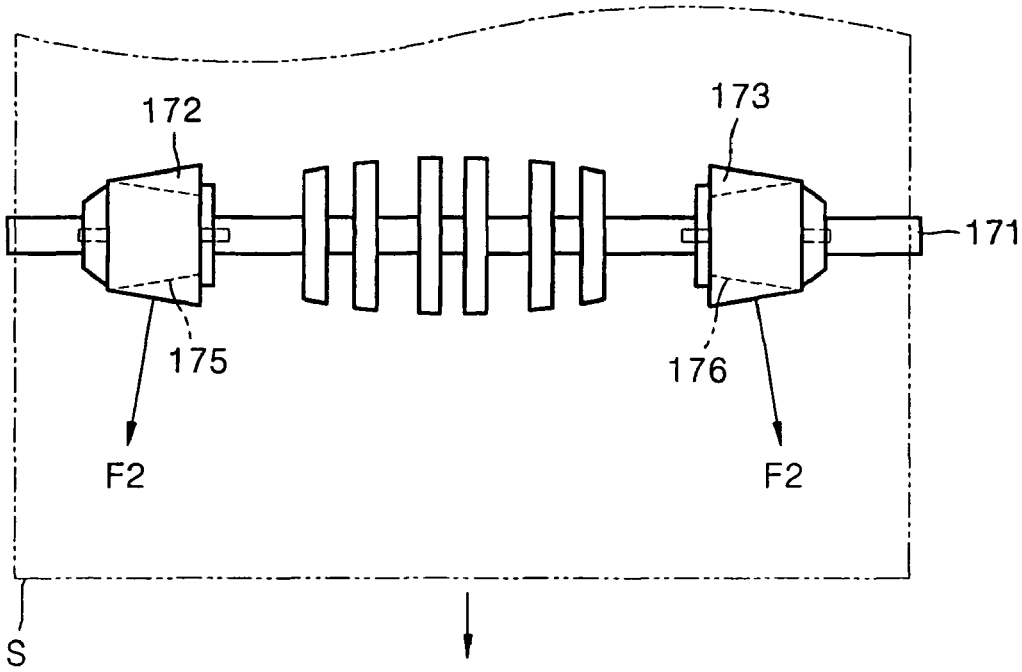
FIG. 5 is a plan view of the paper discharge device of FIG. 3.

FIG. 3 is a side view of the structure of an image forming apparatus adopting a paper discharge device according to a first embodiment of the present invention, FIG. 4 is a front view of the paper discharge device of FIG. 3, and FIG. 5 is a plan view of the paper discharge device of FIG. 3.

Referring to FIG. 3, a paper cassette 110, on which print paper S is mounted, is attachable and detachable to and from an image forming apparatus 100. Moreover, the paper cassette 110 is installed under the main body 101. A pickup roller 120 picks up print paper S sheet by sheet and is installed on the paper cassette 110.

The image forming apparatus 100 comprises a developing device 140, an exposure device 142, a transfer roller 150, a fusing device 160, and a paper discharge unit 170. Each component is disposed along a transfer path of the print paper S.

The developing device 140 supplies toner as a developing agent to an electrostatic latent image formed on a photosensitive medium to develop a toner image. The developing unit 130 is installed to attach to and detach from the main body 101. The developing unit 130 comprises a photosensitive drum 141 that has a portion exposed to the outside.

The exposure device 142 forms an electrostatic latent image on the surface of the photosensitive drum 141 in response to print data. A laser scanning unit (LSU) radiates light irradiated from a light source on the surface of the photosensitive drum 141 and is generally used as the exposure device 142.

The transfer roller 150 is installed to face the photosensitive drum 141. The transfer roller 150 also transfers the toner image formed on the photosensitive drum 141 to the print paper S.

The fusing device 160 fuses the toner image on the print paper S by heat and pressure. After applying heat and pressure on the print paper S, the toner image is transferred. In general, the fusing device 160 comprises a heating roller to generate heat and a pressing roller to press the print paper S.

The paper discharge device 170 discharges the print paper S on which the toner image is fused by the fusing device 160 to the outside of the main body 101. As shown in FIG. 4, the paper discharge device 170 comprises paper discharge rollers 172, 173 and idle rollers 175, 176 which face the paper discharge rollers 172, 173.

An intermediate roller 174 is installed in the middle portion of a paper discharge shaft 171. The paper discharge rollers 172, 173 are installed at both sides of the intermediate roller 174. The intermediate roller 174 has a tapered structure having a diameter that becomes gradually smaller at one end. Therefore, the middle portion of the discharged print paper S is preferably pressed concavely to prevent wrinkling of the print paper S.

Each of the paper discharge rollers 172, 173 preferably has a substantially cone shape and an internal diameter D1 that is larger than an external diameter D2. Thus, each of the paper discharge rollers 172, 173 preferably has an inclined angle of about 0.

The idle rollers 175, 176 face and contact the paper discharge rollers 172, 173, respectively. The idle rollers 175, 176 are preferably substantially cone shaped and have an external diameter d1 that is larger than an internal diameter d2 (converse to the paper discharge rollers 172 and 173). Rotation shafts 177, 178 of the idle rollers 175, 176 extend parallel to the paper discharge shaft 171 of the paper discharge rollers 172, 173.

In addition, each of the idle rollers 175, 176 preferably has an inclined angle of about θ. The inclined angle is about the same as that of each of the paper discharge rollers 172, 173. The range of the inclined angle is about, $0° \leqq \theta \leqq 30°$, and preferably between about $2° \leqq \theta \leqq 15°$.

Thus, each of the paper discharge rollers 172, 173 contacts each of the idle rollers 175, 176 in a longitudinal direction uniformly so that a nip between each of the paper discharge rollers 172, 173 and each of the idle rollers 175, 176 is preferably inclined by the angle of about from an inside of each of the paper discharge rollers 172, 173 to an outside thereof.

As shown in FIG. 4, a component of velocity V1 at the internal diameter D1 of each of the paper discharge rollers 172, 173 contacts each of the idle rollers 175, 176 and is larger than a component of velocity V2 at the external diameter D2 of each of the paper discharge rollers 172 and 173. Thus, a frictional force F2 acts from an inside to an outside. The frictional force F2 acts so that the print paper S is unfolded from the inside to the outside. Thus, wrinkling of the print paper S is prevented.

Figure 6:
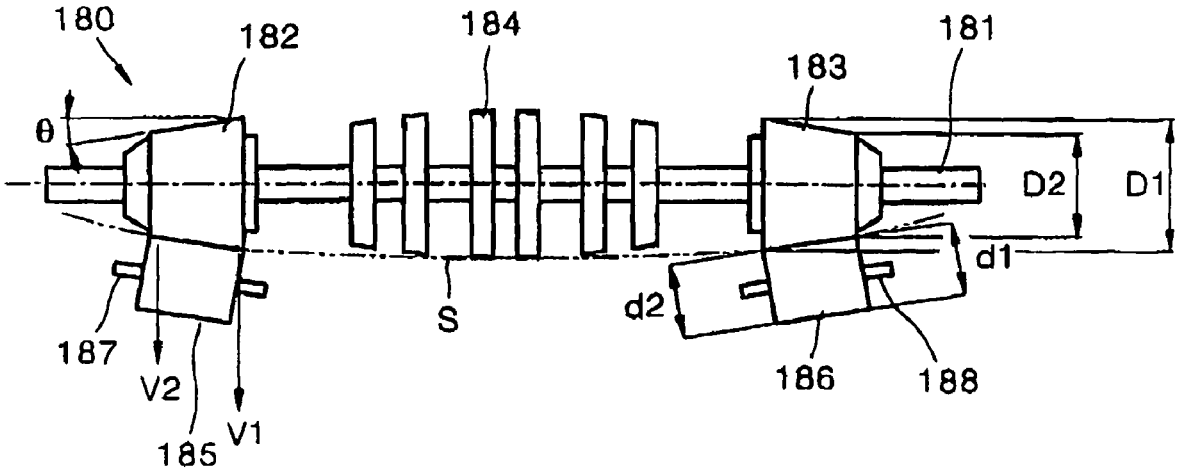
FIG. 6 is a front view of a paper discharge device in accordance with a second embodiment of the present invention.
Figure 7:
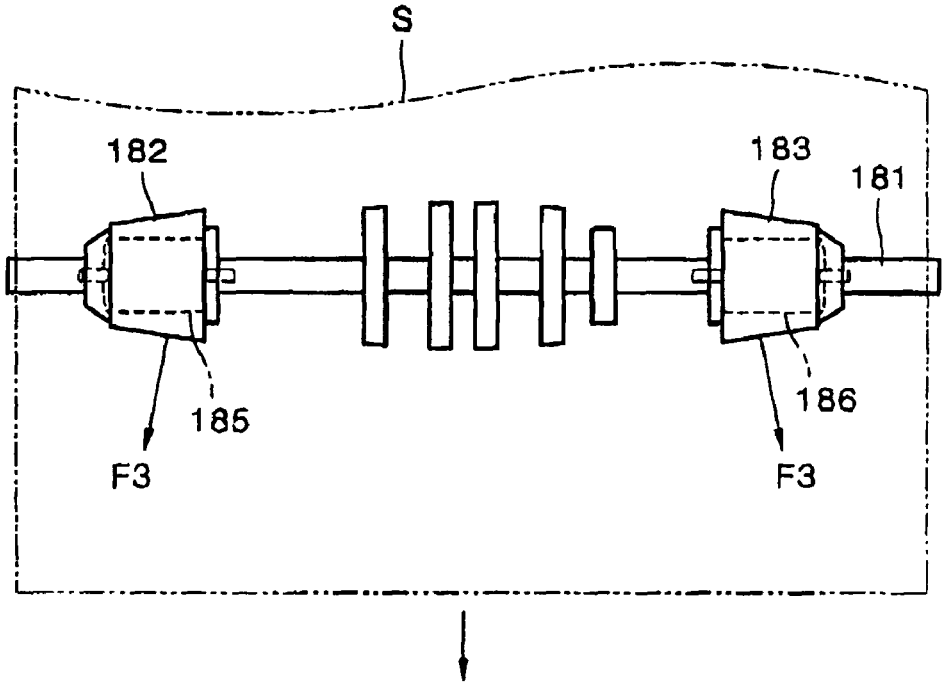
FIG. 7 is a plan view of the paper discharge device of FIG. 6.

FIG. 6 is a front view of a paper discharge device in accordance with a second embodiment of the present invention. FIG. 7 is a plan view of the paper discharge device of FIG. 6.

Referring to FIGS. 6-7, a paper discharge device 180 discharges the print paper S on which the toner image is fused by the fusing device 160 (see FIG. 3) to the outside of the main body 101 (see FIG. 3). As shown in FIG. 6, the paper discharge device 180 comprises paper discharge rollers 182, 183 and idle rollers 185, 186 which face the paper discharge rollers 182, 183.

An intermediate roller 184 is installed in the middle portion of a paper discharge shaft 181, which forms a first longitudinal axis, and the paper discharge rollers 182, 183 are installed at both sides of the intermediate roller 184. The intermediate roller 184 has a tapered structure in which the diameter becomes gradually smaller at one end. Therefore, the middle portion of the discharged print paper S is pressed concavely to prevent wrinkling.

Each of the paper discharge rollers 182, 183 is preferably substantially cone shaped and has an internal diameter D1 larger than an external diameter D2. Thus, each of the paper discharge rollers 182, 183 has an inclined angle with respect to the first longitudinal axis roughly equal to θ.

The idle rollers 185, 186 face and contact the paper discharge rollers 182, 183, respectively, and have a uniform diameter extending in a longitudinal direction. Rotation shafts 187, 188 of the idle rollers 185, 186 form second and third longitudinal axes, respectively, which are at predetermined angles with respect to the longitudinal axis of the paper discharge shaft 181.

In addition, the first and second longitudinal axes of each of the idle rollers 185, 186 preferably have an inclined angle roughly equal to θ, which is the same as that of each of the paper discharge rollers 182, 183. The range of the inclined angle is about, $0° \leqq \theta \leqq 30°$, and preferably roughly equal to about $2° \leqq \theta \leqq 15'$. Although the inclined angles of the second and third longitudinal axes are the same, the are mirror images of one another. That is, the second longitudinal axis is at an angle θ clockwise with respect to the first longitudinal axis, while the third longitudinal axis is at an angle θ counter-clockwise with respect to the first longitudinal axis.

Thus, each of the paper discharge rollers 182, 183 contacts each of the idle rollers 185, 186 in the longitudinal direction uniformly. Thus, a nip between each of the paper discharge rollers 182, 183 and each of the idle rollers 185, and 186 is inclined by the inclined angle roughly equal to 0 from an inside of each of the paper discharge rollers 182, 183 to an outside thereof.

As shown in FIG. 6, a component of velocity V1 at the internal diameter D1 of each of the paper discharge rollers 182, 183 contacts each of the idle rollers 185, 186 and is larger than a component of velocity V2 at the external diameter D2 of each of the paper discharge rollers 182, 183. A frictional force F3 acts from an inside to an outside. The frictional force F3 acts so that the print paper S is unfolded from the inside to the outside. Thus, wrinkling of the print paper S is prevented.

Figure 8:
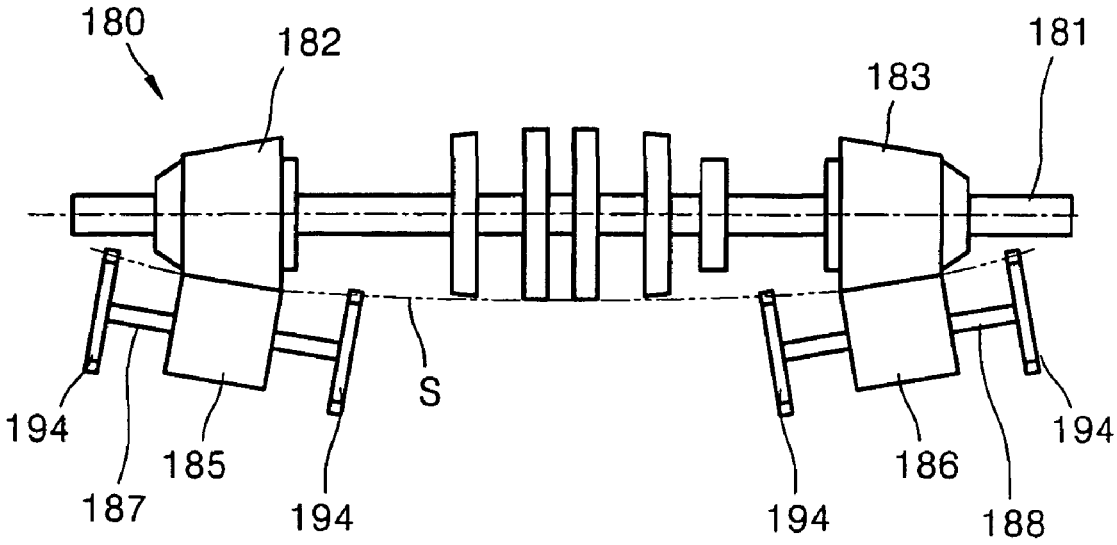
FIG. 8 is a front view of a paper discharge device in accordance with a third embodiment of the present invention.
Figure 9:
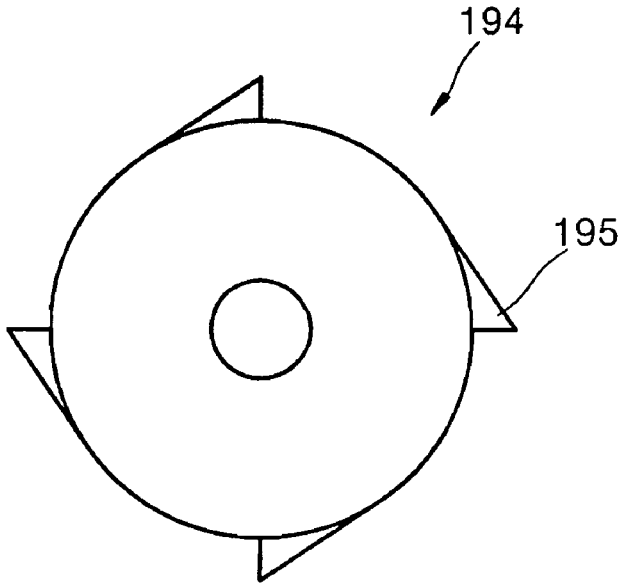
FIG. 9 shows a kicker of the paper discharge device of FIG. 8.

FIG. 8 is a front view of a paper discharge device in accordance with a third embodiment of the present invention. FIG. 9 shows a kicker of FIG. 8.

Referring to FIGS. 8-9, the configuration of the paper discharge device is the same as that of the paper discharge device 180 of FIGS. 6-7. The only difference is the discharge unit 194 has a plurality of kickers 195 formed along a circumferential direction to contact ends of the print paper S at both sides of the idle rollers 185, 186.

When the ends of the print paper S pass through a nip between each of the paper discharge rollers 182, 183 and each of the idle rollers 185 and 186, the discharge unit 194 allows the kickers 195 to hit the ends of the print paper S. Thus, the print paper S is smoothly discharged to the outside.

As described above, the paper discharge device according to the present invention has the following advantages. First, a paper discharge roller and an idle roller contact each other uniformly and apply uniform pressure in a longitudinal direction. Thus, partial wear of the rollers is prevented and the overall life of the paper discharge device is increased. Thus, the reliability thereof is improved. Second, print paper is discharged in the same direction regardless of the state of the print paper so that a high print quality is achieved and the print paper is stacked stably.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

a developing device to develop an image on a print paper;

a fusing device to fuse the image on the print paper, the fusing device having a heating roller and a pressing roller engaged with each other; and a paper discharge device to receive the printing paper having the fused image from the fusing device and discharge the paper to an exterior of the image forming apparatus, the paper discharging device having a plurality of paper discharge rollers arranged in a direction perpendicular to a paper discharging direction and a plurality of idle rollers facing the plurality of paper discharge rollers to discharge the print paper between the plurality of paper discharge rollers and the plurality of idle rollers;

wherein the plurality of paper discharge rollers have non-uniform diameter portions extending in a longitudinal direction and an internal end of each of the plurality of paper discharge rollers is larger than its opposing external end such that at a nip between each paper discharge roller and its corresponding idle roller, a velocity at the internal end is larger than a velocity at the external end and the print paper bends according to the non-uniform diameter portion of the paper discharge roller as the paper is discharged by the paper discharge device.

2. The image forming apparatus of claim 1, wherein each of the plurality of idle rollers has a uniform diameter in the longitudinal direction.

3. The image forming apparatus of claim 2, wherein the non-uniform diameter portion of the paper discharge roller has an inclined angle between about 0 and 30 degrees.

4. The image forming apparatus of claim 3, wherein at least one of the paper discharge roller or the idle roller has an inclined angle between about 2 and 15 degrees.

5. The image forming apparatus of claim 1, wherein at least one of the idle rollers comprises a discharge unit having a plurality of kickers that contacts ends of the print paper to discharge the print paper.

6. The image forming apparatus of claim 1, wherein the paper is bent in a first direction when the paper is discharged by the fusing device, and wherein the paper discharge device is configured to bend the print paper in a second direction opposite to the first direction.

7. The image forming apparatus of claim 1, wherein each of the plurality of idle rollers has a non-uniform diameter portion corresponding to the non-uniform diameter portion of the paper discharge roller.

8. The image forming apparatus of claim 7, wherein a diameter at an external end of the non-uniform diameter portion of each of the plurality of idle rollers is larger than a diameter at an internal end thereof in the longitudinal direction.

9. The image forming apparatus of claim 8, wherein the non-uniform diameter portion of the idle roller has an inclined angle between about 0 and 30 degrees.

10. The image forming apparatus of claim 1, further comprising an intermediate roller having a taper structure between the plurality of paper discharge rollers.

11. The image forming apparatus of claim 10, wherein the intermediate roller and the plurality of paper discharge rollers are formed such that a first space is provided between a first edge of the intermediate roller and one of the plurality of paper discharge rollers and a second space is provided between a second edge of the intermediate roller and the other of the plurality of paper discharge rollers.

12. An image forming apparatus comprising:

a developing device to develop an image on a print paper;

a fusing device to fuse the image on the print paper, the fusing device having a heating roller and a pressing roller engaged with each other; and a paper discharging device to receive the printing paper having the fused image from the fusing device and discharge the paper to an exterior of the image forming apparatus, wherein the paper discharging device includes a first paper discharge roller, a second paper discharge roller, a first idle roller, and a second idle roller so as to discharge the print paper between the paper discharge rollers and the idle rollers;

each of the paper discharge rollers has non-uniform diameter configuration extending in a longitudinal direction and an internal end of each of the plurality of paper discharge rollers is larger than its opposing external end such that at a nip between each paper discharge roller and its corresponding idle roller, a velocity at the internal end is larger than a velocity at the external end and the print paper bends according to the non-uniform diameter configurations of the paper discharge rollers as the paper is discharged by the paper discharge device.

13. The image forming apparatus of claim 12, wherein each of the idle rollers has a non-uniform diameter configuration corresponding to the non-uniform diameter configuration of the paper discharge rollers.

14. The image forming apparatus of claim 13, wherein the first paper discharge roller and the second paper discharge roller are mounted on a paper discharge shaft.

15. The image forming apparatus of claim 14, wherein an intermediate roller portion is mounted on the paper discharge shaft between the first paper discharge roller and the second paper discharge roller.

16. The image forming apparatus of claim 15, wherein the intermediate roller portion and paper discharge rollers are mounted such that a first space is provided between a first edge of the intermediate roller portion and the first paper discharge roller and a second space is provided between a second edge of the intermediate roller portion and the second paper discharge roller.

17. The image forming apparatus of claim 16, wherein the intermediate roller portion is configured to have a tapered structure.

* * * * *